US009698520B2

(12) United States Patent
Spear et al.

(10) Patent No.: US 9,698,520 B2
(45) Date of Patent: Jul. 4, 2017

(54) SHROUDED CABLE CONNECTOR WITH VENTILATION

(71) Applicants: Brian Hartwell Spear, Worcester, MA (US); Nicolas Martinez, Maisons-Alfort (FR)

(72) Inventors: Brian Hartwell Spear, Worcester, MA (US); Nicolas Martinez, Maisons-Alfort (FR)

(73) Assignee: Prothia s.a.r.l., Paris (FR)

( * ) Notice: Subject to any disclaimer, the term of this patent is extended or adjusted under 35 U.S.C. 154(b) by 0 days.

(21) Appl. No.: 14/937,584

(22) Filed: Nov. 10, 2015

(65) Prior Publication Data

US 2017/0133786 A1 May 11, 2017

(51) Int. Cl.

| | |
|---|---|
| ***H01R 4/60*** | (2006.01) |
| ***H01R 4/64*** | (2006.01) |
| ***H01R 13/52*** | (2006.01) |
| ***H01R 43/00*** | (2006.01) |

(52) U.S. Cl.
CPC ..... *H01R 13/5227* (2013.01); *H01R 43/005* (2013.01)

(58) Field of Classification Search
CPC ..... H01R 13/5227
USPC ..... 439/206, 205
See application file for complete search history.

(56) References Cited

U.S. PATENT DOCUMENTS

| | | | | |
|---|---|---|---|---|
| 4,123,131 | A | 10/1978 | Pearce, Jr. et al. | |
| 4,185,886 | A | 1/1980 | Corrales | |
| 4,553,807 | A * | 11/1985 | Cane | H01R 13/533 439/190 |
| 4,615,115 | A | 10/1986 | Bosshard et al. | |
| 4,802,867 | A | 2/1989 | Palmer | |
| 5,007,852 | A * | 4/1991 | Dean | H01R 13/523 439/201 |
| 5,816,835 | A | 10/1998 | Meszaros | |
| 6,332,787 | B1 * | 12/2001 | Barlow | H01R 13/5227 439/138 |
| 7,494,355 | B2 * | 2/2009 | Hughes | H01R 4/70 439/181 |
| 7,854,620 | B2 * | 12/2010 | Hughes | H01R 13/035 439/181 |
| 7,963,783 | B2 | 6/2011 | Hughes | |
| 8,056,581 | B2 | 11/2011 | Danielson et al. | |
| 8,132,969 | B2 | 3/2012 | Liu et al. | |
| 8,911,247 | B2 | 12/2014 | Casas et al. | |
| 2007/0224865 | A1 * | 9/2007 | Fangrow | A61M 39/10 439/205 |
| 2013/0079730 | A1 | 3/2013 | Mosler et al. | |

* cited by examiner

*Primary Examiner* — Hae Moon Hyeon
(74) *Attorney, Agent, or Firm* — Reinhart Boerner Van Deuren P.C.

(57) ABSTRACT

A shrouded connector and associated methods of manufacture are provided. The shrouded connector includes an insulating shroud which includes at least one ventilation passageway which communicates an internal cavity of the insulating shroud with an annular space of the insulating shroud, the annular space adjacent an exterior of the insulating shroud.

22 Claims, 4 Drawing Sheets

SHROUDED CABLE CONNECTOR WITH VENTILATION

FIELD OF THE INVENTION

This invention generally relates to electrical termination, and more particularly to cable connectors.

BACKGROUND OF THE INVENTION

Twenty-first century medicine uses more and more electronic devices. Standards for patient and user safety require protection of medical connectors to reduce the risk of contact with high voltage. For example, International Standards Organization (ISO) Standard 60601 1 specifies that connectors must be so protected.

As a result, shrouded connectors are employed for various applications, including but not limited to applications in the contemporary medical operational environment. Such shrouded connectors typically include an electrical conductor, e.g. a bi-polar or uni-polar pin, which is surrounded by an insulating housing referred to as a shroud. The insulating shroud essentially surrounds the electrical conductor such that the risk of direct human contact with the electrical conductor is reduced or entirely eliminated.

In the context of medical applications, health care providers often autoclave and re-use devices, including cables. Autoclaving is a steam or other gaseous sterilization process which, in the context of cables used in medical applications, creates, particularly with steam sterilization widespread in hospitals, the risk of entrapment of fluid in the connector(s) at the end(s) of the cable. This risk is particularly problematic in shrouded connectors, as the insulating shroud has internal cavities and areas in which condensed fluid from the autoclaving process may undesirably reside. This residual fluid can compromise the quality of conduction and can also degrade the cable, rendering it unserviceable.

As such, there is a need in the art for a shrouded connector which reduces or eliminates the risk of fluid entrapment as a result of autoclaving. Such a connector should be minimalistic in its design, low-cost, yet robust to allow for multiple usage and autoclaving cycles.

The invention provides such a ventilated cable connector. These and other advantages of the invention, as well as additional inventive features, will be apparent from the description of the invention provided herein.

BRIEF SUMMARY OF THE INVENTION

In one aspect, a shrouded connector for an electrical cable is provided herein. This shrouded connector advantageously overcomes existing problems in the art, in part, by providing at least one ventilation passageway therein. Specifically, the shrouded connector according to this aspect includes a conductive element, and an insulating shroud. The insulating shroud defines a major longitudinal axis and has an internal cavity for receipt of the conductive element. The insulating shroud also includes a plurality of ventilation passageways running parallel to the major longitudinal axis of the insulating shroud. The plurality of ventilation passageways are disposed adjacent the conductive element and in communication with the internal cavity.

According to this aspect, the conductive element may be a single pin connector. The insulating shroud may be formed as a one piece integral component. The insulating shroud can include an interior passageway for routing electrical wiring.

The interior passageway communicates with the internal cavity of the insulating shroud.

According to this aspect, the plurality of ventilation passageways may be circumferentially arranged relative to the conductive element and equally spaced in a circumferential direction. The plurality of ventilation passageways may for example include four ventilation passageways which are spaced apart 90° in a circumferential direction.

According to this aspect, each of the plurality of ventilation passageways may have a generally square or rectangular cross-sectional shape. Each of the plurality of ventilation passageways may also terminate in an opening. The opening of each of the ventilation passageways faces an annular space of the insulating shroud. The annular space is formed by an overlap of a first portion of the insulating shroud and a second portion of the insulating shroud.

In another aspect, an insulating shroud for a shrouded cable connector is provided. The insulating shroud includes a longitudinally extending first portion defining an interior passageway. The interior passageway is configured for routing of electrical wiring. The first portion has an axial face.

The insulating shroud also includes a longitudinally extending second portion which extends from the axial face of the first portion. The second portion includes at least one ventilation passageway therein. The at least one ventilation passageway is in communication with an internal cavity of the second portion.

The insulating shroud also includes an annular space which is defined between the second portion and the first portion. The at least one passageway terminates at an opening facing the annular space which communicates the internal cavity of the second portion with the annular space. According to this aspect, the first and second portions of the insulating shroud form a one piece interval component. Additionally, the at least one ventilation passageway may include a plurality of ventilation passageways which are circumferentially arranged relative to the internal cavity and equally spaced in a circumferential direction. As an example, the plurality of ventilation passageways may include four ventilation passageways which are spaced apart 90° in the circumferential direction. Further, each of the plurality of ventilation passageways have a generally square or rectangular cross-sectional shape.

According to this aspect, a retention collar may be formed within the internal cavity. The retention collar is configured to retain an electrical conductor when situated within said internal cavity. Furthermore, the first portion may include an annular wall which projects from the axial face of the first portion. The annular wall axially overlaps an axial length of the second portion to form a boundary of the annular space.

According to this aspect, an axial length ratio between an axial length of the annular wall and an axial length of the opening of the at least one ventilation passageway is between about 3:1 and 2:1.

In yet another aspect, a shrouded connector for an electrical cable is provided. The shrouded connector includes a conductive element. The conductive element is a single pin connector. The shrouded connector also includes an insulating shroud. The insulating shroud defines a major longitudinal axis and has an internal cavity for receipt of the conductive element. The insulating shroud includes a longitudinally extending first portion which defines an interior passageway configured for routing of electrical wiring. The first portion also has an axial face. The insulating shroud also includes a longitudinally extending second portion which extends from the axial face of the first portion.

The insulating shroud also includes an annular space which is defined between the second portion and the first portion. The annular space is formed by an overlap of the first portion of the insulating shroud and the second portion of the insulating shroud.

A plurality of ventilation passageways which run parallel to the major longitudinal axis of the insulating shroud are also provided. The plurality of ventilation passageways are disposed adjacent the conductive element and in communication with the internal cavity. The plurality of ventilation passageways each communicate the internal cavity with the annular space.

The plurality of ventilation passageways are circumferentially arranged relative to the conductive element and equally spaced in a circumferential direction such that they are spaced apart 90° in a circumferential direction. Each of the plurality of ventilation passageways terminates in an opening. The opening of each of the plurality of ventilation passageways faces the annular space of the insulating shroud. The insulating shroud is a one piece integral component.

In yet another aspect, a method of forming a shrouded connector for an electrical cable is provided. The method includes the steps of providing a conductive element and forming an insulating shroud as a one piece integral component such that the insulating shroud defines a major longitudinal axis and has an internal cavity for receipt of the conductive element. This step of forming also includes forming the insulating shroud such that it has a plurality of ventilation passageways running parallel to the major longitudinal axis of the insulating shroud. The plurality of ventilation passageways are disposed adjacent to the internal cavity. This method also includes terminating the conductive element with electrical wiring. This method also includes situating the conductive element within the internal cavity. This step of situating may also include axially inserting the conductive element into the insulating shroud until it abuts a stop formed in the insulating shroud.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the illustrated embodiment, FIGS. 1-4 illustrate an exemplary embodiment of a shrouded connector according to the teachings herein. As will be understood from the following, the shrouded connector described herein overcomes existing problems in the art by providing a ventilation path for accumulated fluids as a result of autoclaving or other processes. The shrouded connector includes an insulating shroud which is formed as one piece integral construction which, despite its one piece integral design, provides the aforementioned ventilation path. Further, the shrouded connector advantageously may obviate the necessity of any adhesives or the like when assembling its insulating shroud with its internal conductive element.

Figure 1:
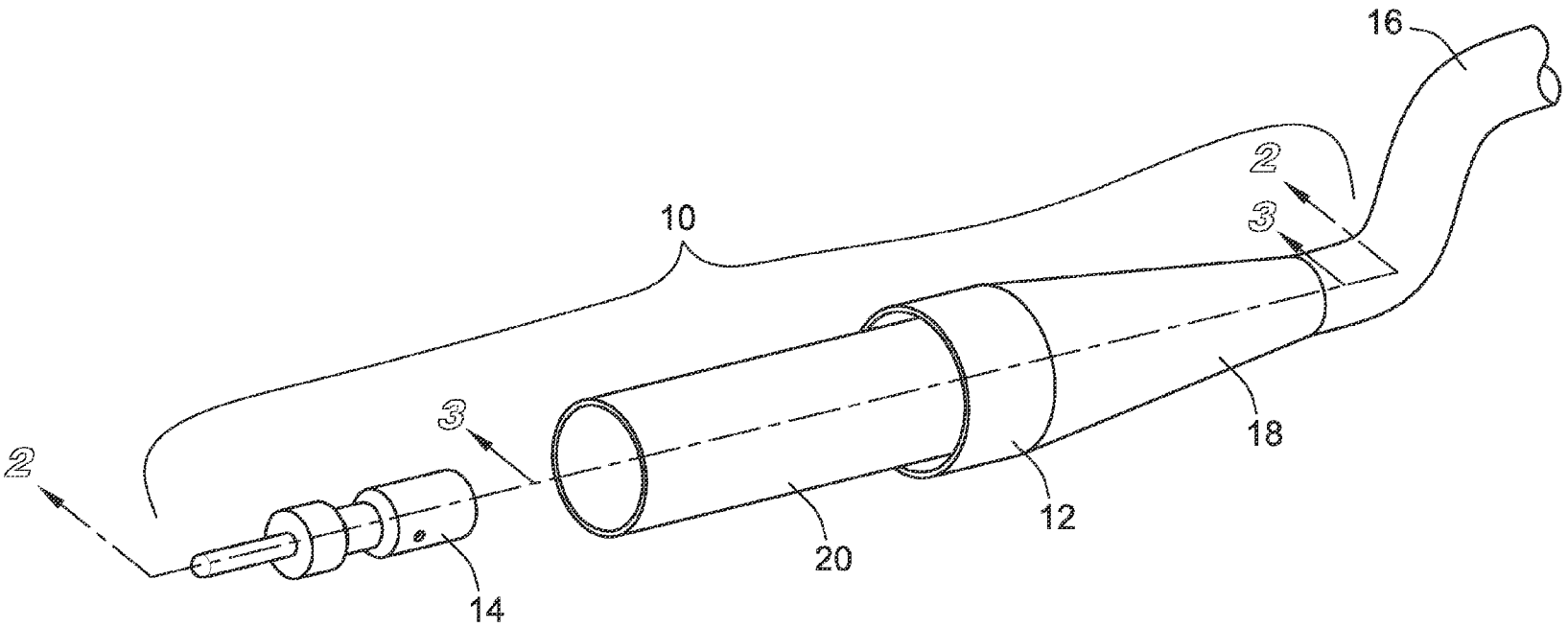
FIG. 1 is an exploded perspective view of an exemplary embodiment of a shrouded cable connector according to the teachings of the present invention.

With particular reference to FIG. 1, a perspective view of the shrouded connector 10 is illustrated. Shrouded connector 10 includes an insulating shroud 12 which receives a conductive element 14. Insulating shroud 12 defines a major longitudinal axis which conductive element 14 is inserted along to install the same into insulating shroud 12. Electrical wiring 16 is routed through insulating shroud 12 and terminated to conductive element 14. Although a single shrouded connector 10 is illustrated, it will be readily recognized that both ends of electrical wiring 16 may include identical shrouded connectors 10. Furthermore, an entirely different connector may be utilized at the other end of electrical wiring 16. Yet further, electrical wiring 16 may be permanently connected to a device at one end, with a shrouded connector 10 at the other end.

The particular conductive element 14 illustrated is a single pin bi-polar connector. However, this style of conductive element 14 should be taken by way of example only. Indeed, shrouded conductive 10 may utilize any conductive element within its insulating shroud 12. Those of skill in the art will also recognize that the particular electrical wiring utilized may change as a result of a change in the conductive element as well.

Figure 2:
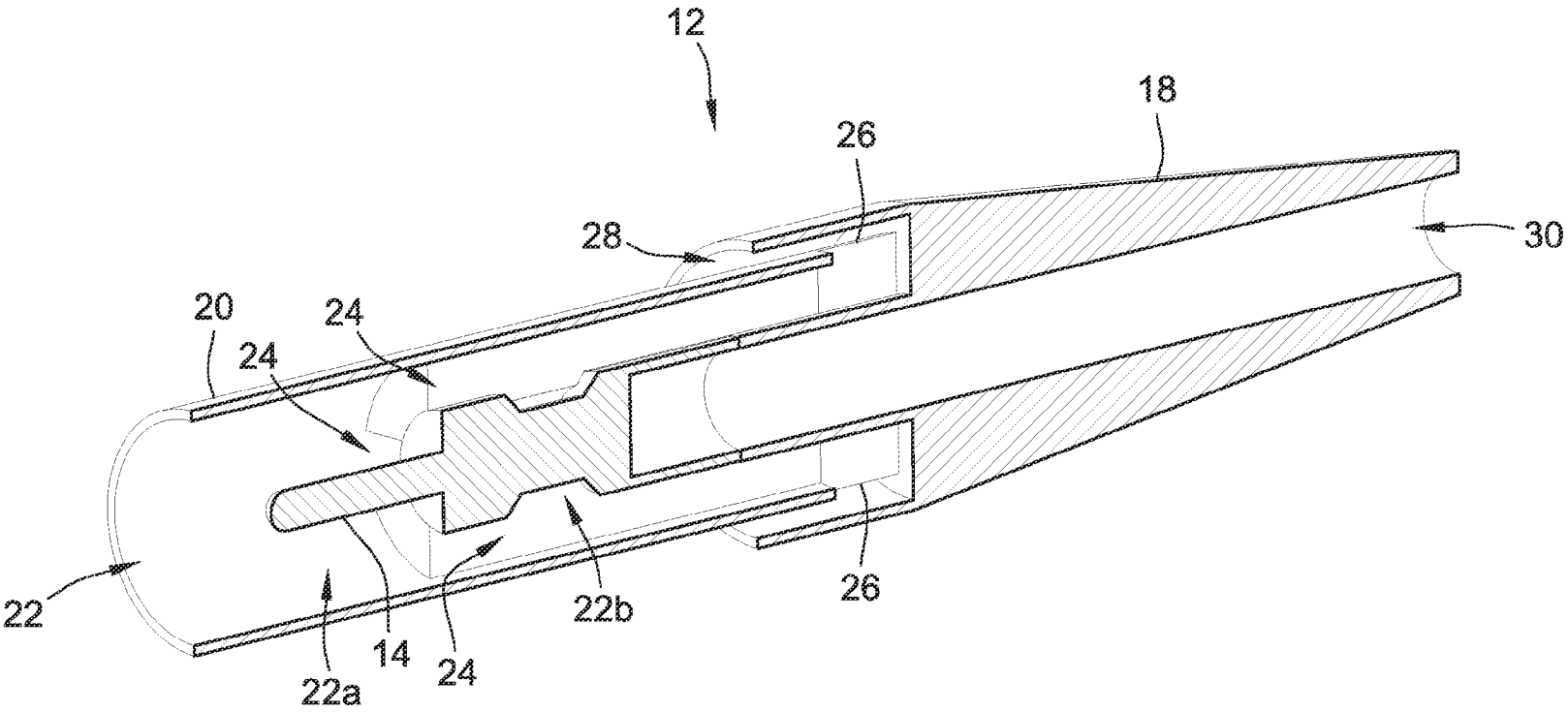
FIG. 2 is a side cross section of the connector of FIG. 1.

Turning now to FIG. 2, a cross-section of shrouded connector 10 is illustrated therein. In this view, conductive element 14 is fully installed within insulating shroud 12. It will be noted from inspection of FIGS. 1 and 2 that one end of insulating shroud 12 is tapered. This taper, while not required, advantageously provides additional strain relief to electrical wiring 16 (See FIG. 1). Insulating shroud 12 may be formed by a plastic material, or any other suitable material utilized for the construction of connectors.

Furthermore, insulating shroud 12 is formed as a one piece integral component. The terms "one piece" and "integral" as used herein mean that insulating shroud 12 is a single contiguous piece made from a single material. As one example, such formation as a one piece integral component may be achieved by molding. A one piece integral component, as used herein, is not meant to include assembly of components made by joining separate components together by welding, adhesives, or the like.

Still referring to FIG. 2, insulating shroud 12 includes an internal cavity 22. This internal cavity 22 includes an enlarged cavity portion 22*a* and a relatively smaller cavity portion 22*b*. From inspection of FIG. 2, it will be recognized that this smaller cavity portion 22*b* is where a majority of conductive element 14 resides. However, the pin end portion of conductive element 14 extends into enlarged cavity portion 22*a* as shown. Insulation shroud 12 also includes a plurality of ventilation passageways 24. These ventilation passageways 24 run parallel to the major longitudinal axis of insulation shroud 12. Each of these ventilation passageways 24 has a generally square or rectangular cross-section. However, other cross-sectional shapes could also be utilized. By "generally" square or rectangular, it is meant that portions of this cross-section of passageway 24 are slightly curved (see FIG. 4) to conform to the overall cylindrical shape of insulation shroud 12.

Each passageway 24 is open in the radial direction such that it communicates with smaller cavity portion 22*b*. One end of each passageway 24 is open in the axial direction such that it opens to enlarged cavity portion 22*a*. The other end of each passageway terminates in a radially outward facing opening 26 as shown. This radially outwardly facing opening 26 communicates internal cavity 22 with an annular space 28 defined between an axial overlap of a first portion 18 and a second portion 20 of insulation shroud 12. This axial overlap inhibits ingress of fluid back into passageways 24 through opening 26 from an exterior of insulation shroud 12. Put differently, openings 26 are not directly exposed to the exterior of insulation shroud 12, but are instead exposed to this annular space 28 introduced above.

As a result of the aforementioned configuration of passageways 24, steam or other gaseous compounds which would accumulate and condense within internal cavity 22 may flow axially through passageway 24 to opening 26 and then out through annular space 28. Such a configuration advantageously allows for the ventilation of insulation shroud 12, and ultimately, the ventilation of shrouded connector 10.

Figure 3:
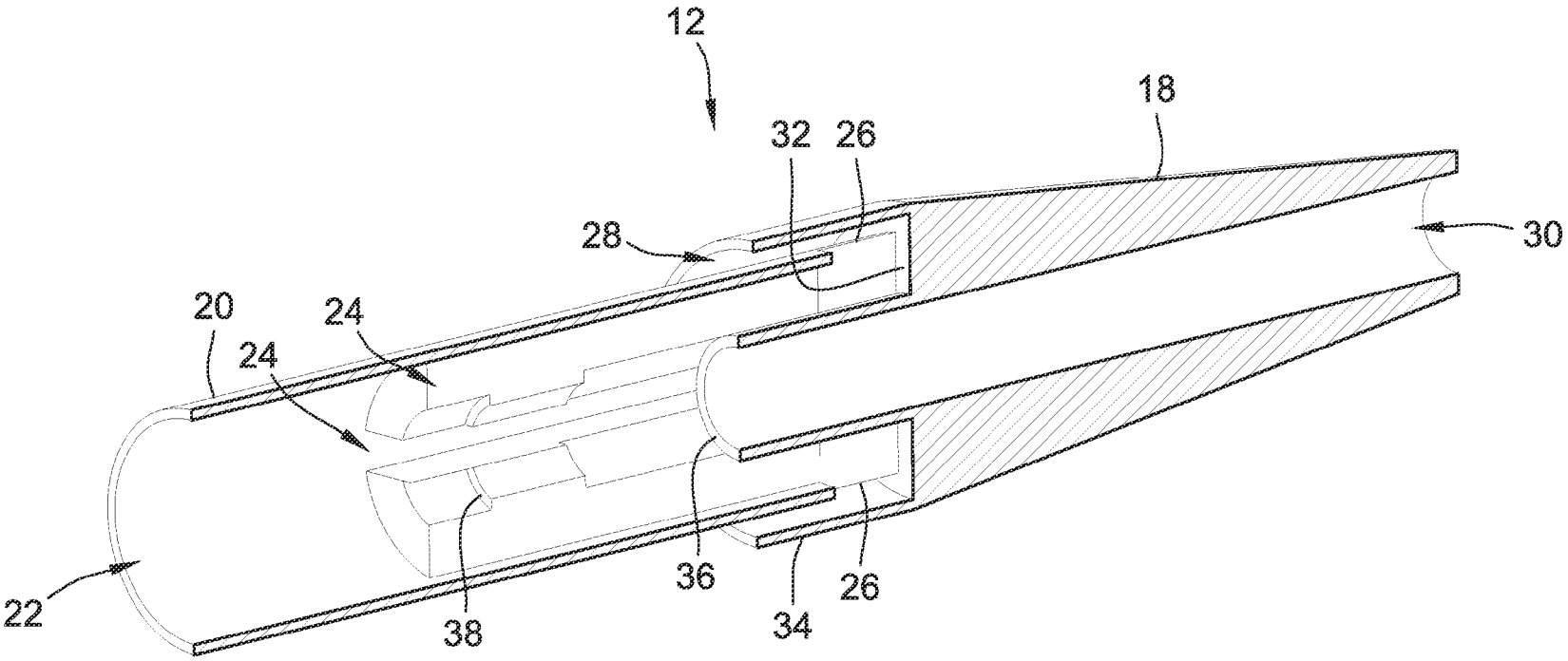
FIG. 3 is another side cross section of the connector of FIG. 1.

Turning now to FIG. 3, first portion 18 defines an axial face 32 as shown. Second portion 20 extends from this axial face 32 of first portion 18. Annular space 28 has an outer periphery which is defined by an annular wall 34 which also extends from axial face 32. This annular wall 34 overlaps openings 26 as shown. In the particular illustrated embodiment, there is an axial length overlap ratio between annular wall 34 and opening 26 of about 2:1. However, this overlap may be other ratios as well, and the foregoing is made for exemplary purposes only. Indeed, as another example, this overlap ratio may be between 3:1 and 2:1. Any ratio may be utilized, however, and the foregoing is for exemplary purposes only.

Additionally, internal cavity 22 may also include an axial stop 36 as shown. This axial stop is situated at an end of an internal passageway 30 of first portion 18. Referring momentarily back to FIG. 2, axial stop 36 defines an abutment surface against which conductive element 14 abuts against when it is fully installed within internal cavity 22. Furthermore, to prevent the undesirable event of conductive element 14 moving back out of internal cavity 22 once installed, internal cavity 22 may also include a collar 38 formed by discrete radial projections within internal cavity 22 as shown. These radial projections nest radially inward into conductive element 14 to axially locate and fix conductive element 14 within internal cavity 22. As a result of this configuration, adhesives or other mechanical joining means are not required to fix conductive element 14 within insulating shroud 12. Further, this lack of adhesives or the like is also made possible by the close dimensional values of the outer diameter of conductive element 14, and the inner diameter of internal cavity 22, particularly smaller cavity portion 22*b*.

Figure 4:
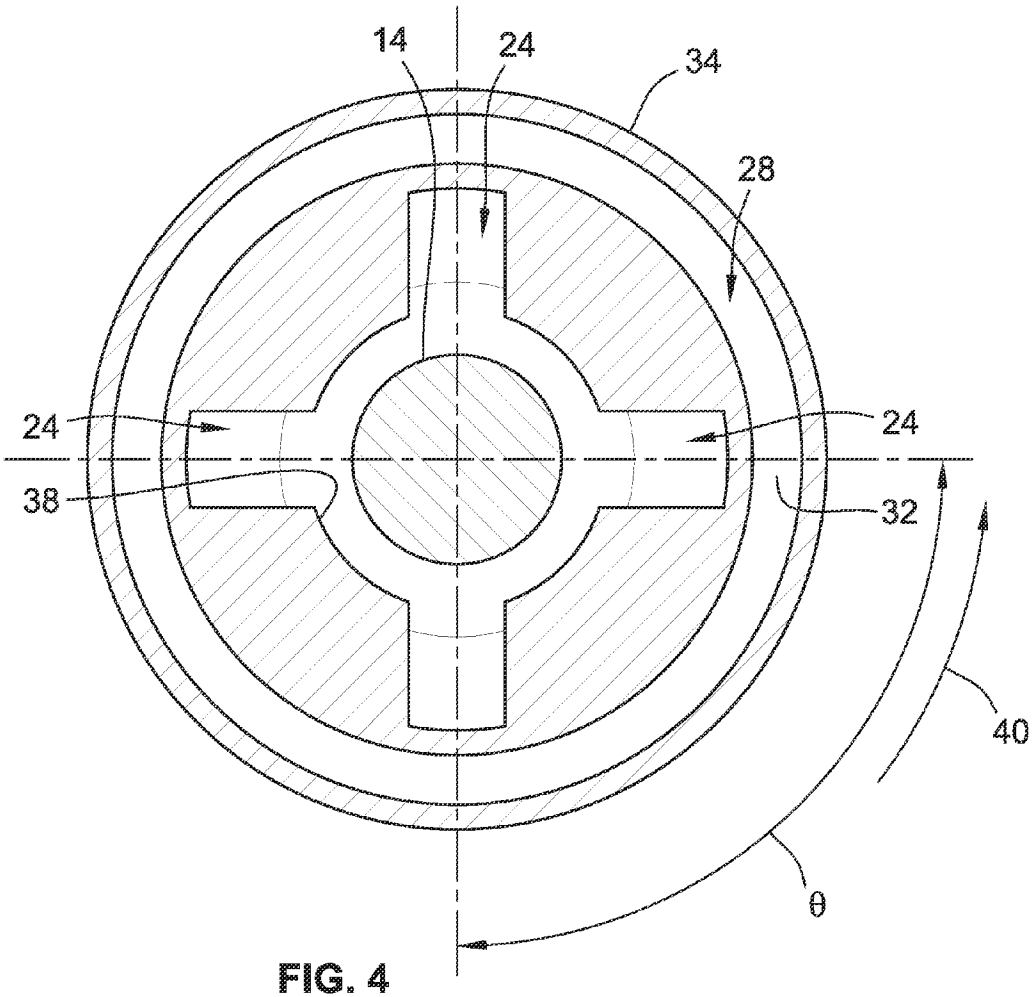
FIG. 4 is a front cross section of the connector of FIG. 1.

Turning now to FIG. 4, a cross-section through passageways 24 is illustrated. In the particular embodiment, there are four total ventilation passageways 24. These passageways 24 are circumferentially arranged in a circumferential direction 40. Each passageway 24 is spaced apart from its adjacent passageway 24 by an angle of theta equal to 90°. It will be readily recognized, however, that any number, size, and geometry of ventilation passageways may be utilized. Indeed, a single passageway could be utilized as another example. Further, the passageways do not need to be equally spaced as described above.

Referring back to FIG. 1, in view of the foregoing structural description, the method of manufacturing a shrouded connector as well as a cable including shrouded connector 10 is advantageously low cost and expedient. Indeed, insulating shroud 12 is formed as an integral one piece component as described above, e.g. by molding. A conductive element 14 is also provided. Electrical wiring 16 is routed through internal passageway 30 of insulation shroud 12 until it is exposed through the internal cavity 22 of second portion 20 thereof. Conductive element 14 is then terminated to electrical wiring by way of soldering or any other known process. Once terminated, electrical wiring 16 is then pulled back through insulation shroud 12 to thereby draw conductive element 14 into internal cavity 22 and seat the same against stop 36 as described above. This operation also positions the radial projections of collar 38 against conductive element 14 also as described above. This process may be readily repeated for the other end of electrical wiring 16 if the cable design so requires.

As described herein, shrouded connector 10 advantageously provides a low cost rapid assembly solution which also advantageously provides ventilation such that any cable incorporating its shrouded connector 10 may be readily autoclaved and reused. This configuration substantially reduces or eliminates entirely the risk of cable degradation due to the ingress of fluid as a result of the autoclaving process.

As a result, a low cost, rapidly manufactured, and ventilated shrouded connector is provided. Such a shrouded connector is particularly advantageous in medical applications where it may be repeatedly autoclaved without ingress of moisture which would otherwise render it unserviceable. However, such medical application should be taken by way of example only. The advantages provided by the shrouded connector herein are not limited to the medical field only.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A shrouded connector for an electrical cable, the connector comprising:

a conductive element;

an insulating shroud, the insulating shroud defining a major longitudinal axis and having an internal cavity for receipt of the conductive element;

wherein the insulating shroud includes a plurality of ventilation passageways running parallel to the major longitudinal axis of the insulating shroud, the plurality of ventilation passageways disposed adjacent the conductive element and in communication with the internal cavity; and wherein the plurality of ventilation passageways are circumferentially arranged relative to the conductive element and equally spaced in a circumferential direction.

2. The shrouded connector of claim 1, wherein the conductive element is a single pin connector.

3. The shrouded connector of claim 1, wherein the insulating shroud is a one piece integral component.

4. The shrouded connector of claim 1, wherein the insulating shroud includes an interior passageway for routing electrical wiring, the interior passageway communicating with the internal cavity of the insulating shroud.

5. The shrouded connector of claim 1, wherein the plurality of ventilation passageways includes four ventilation passageways which are spaced apart 90° in the circumferential direction.

6. The shrouded connector of claim 1, wherein each of the plurality of ventilation passageways has a generally square or rectangular cross sectional shape.

7. A shrouded connector for an electrical cable, the connector comprising:

a conductive element;

an insulating shroud, the insulating shroud defining a major longitudinal axis and having an internal cavity for receipt of the conductive element;

wherein the insulating shroud includes a plurality of ventilation passageways running parallel to the major longitudinal axis of the insulating shroud, the plurality of ventilation passageways disposed adjacent the conductive element and in communication with the internal cavity;

wherein each of the plurality of ventilation passageways terminates in an opening; and wherein the opening of each of the ventilation passageways faces an annular space of the insulating shroud, the annular space formed by an overlap of a first portion of the insulating shroud and a second portion of the insulating shroud.

8. The shrouded connector of claim 7, wherein the conductive element is a single pin connector.

9. The shrouded connector of claim 7, wherein the insulating shroud is a one piece integral component.

10. The shrouded connector of claim 7, wherein the insulating shroud includes an interior passageway for routing electrical wiring, the interior passageway communicating with the internal cavity of the insulating shroud.

11. The shrouded connector of claim 7, wherein the plurality of ventilation passageways includes four ventilation passageways which are spaced apart 90° in the circumferential direction.

12. The shrouded connector of claim 7, wherein each of the plurality of ventilation passageways has a generally square or rectangular cross sectional shape.

13. An insulating shroud for a shrouded cable connector, the insulating shroud comprising:

a longitudinally extending first portion defining an interior passageway configured for routing of electrical wiring, the first portion having an axial face;

a longitudinally extending second portion extending from the axial face of the first portion, the second portion including at least one ventilation passageway therein, the at least one ventilation passageway in communication with an internal cavity of the second portion;

wherein an annular space is defined between the second portion and the first portion;

wherein the at least one ventilation passageway terminates at an opening facing the annular space which communicates the internal cavity of the second portion with the annular space.

14. The insulating shroud of claim 13, wherein the first and second portions form a one piece integral component.

15. The insulating shroud of claim 13, wherein the at least one ventilation passageway includes a plurality of ventilation passageways circumferentially arranged relative to the internal cavity and equally spaced in a circumferential direction.

16. The insulating shroud of claim 15, wherein the plurality of ventilation passageways includes four ventilation passageways which are spaced apart 90° in the circumferential direction.

17. The insulating shroud of claim 13, wherein each of the plurality of ventilation passageways has a generally square or rectangular cross sectional shape.

18. The insulating shroud of claim 13, wherein a retention collar is formed within the internal cavity, the retention collar configured to retain an electrical conductor when situated within said internal cavity.

19. The insulating shroud of claim 13, wherein the first portion includes an annular wall which projects from the axial face of the first portion, the annular wall axially overlapping an axial length of the second portion to form a boundary of the annular space.

20. The insulating shroud of claim 19, wherein an axial length ratio between an axial length of the annular wall and an axial length of the opening of the at least one ventilation passageway is between 3:1 and 2:1.

21. A shrouded connector for an electrical cable, the connector comprising:

a conductive element, the conductive element being a single pin connector;

an insulating shroud, the insulating shroud defining a major longitudinal axis and having an internal cavity for receipt of the conductive element, the insulating shroud further comprising:

a longitudinally extending first portion defining an interior passageway configured for routing of electrical wiring, the first portion having an axial face;

a longitudinally extending second portion extending from the axial face of the first portion;

wherein an annular space is defined between the second portion and the first portion, the annular space formed by an overlap of the first portion of the insulating shroud and the second portion of the insulating shroud;

a plurality of ventilation passageways running parallel to the major longitudinal axis of the insulating shroud, the plurality of ventilation passageways disposed adjacent the conductive element and in communication with the internal cavity, wherein the plurality of ventilation passageways communicate the internal cavity with the annular space;

wherein the plurality of ventilation passageways are circumferentially arranged relative to the conductive element and equally spaced in a circumferential direction such that the plurality of ventilation passageways are spaced apart 90° in the circumferential direction; and wherein each of the plurality of ventilation passageways terminates in an opening, the opening of each of the plurality of ventilation passageways facing the annular space of the insulating shroud;

wherein the insulating shroud is a one piece integral component.

22. A method of forming a shrouded connector for an electrical cable, the method comprising the steps of:

providing a conductive element;

forming an insulating shroud as a one piece integral component such that the insulating shroud defines a major longitudinal axis and has an internal cavity for receipt of the conductive element, and such that the insulating shroud has a plurality of ventilation passageways running parallel to the major longitudinal axis of the insulating shroud, the plurality of ventilation passageways disposed adjacent the internal cavity;

terminating the conductive element with electrical wiring;

situating the conductive element within the internal cavity; and wherein the step of situating the conductive element includes axially inserting the conductive element into the insulating shroud until the conductive element abuts a stop formed in the insulating shroud.

* * * * *